US008878110B2

(12) United States Patent
Travis

(10) Patent No.: US 8,878,110 B2
(45) Date of Patent: Nov. 4, 2014

(54) PROJECTILE THAT INCLUDES PROPULSION SYSTEM AND LAUNCH MOTOR ON OPPOSING SIDES OF PAYLOAD AND METHOD

(75) Inventor: Robert D. Travis, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 412 days.

(21) Appl. No.: 12/967,973

(22) Filed: Dec. 14, 2010

(65) Prior Publication Data

US 2012/0145028 A1 Jun. 14, 2012

(51) Int. Cl.
*F42B 15/01* (2006.01)

(52) U.S. Cl.
USPC ..... 244/3.22; 244/171.1

(58) Field of Classification Search
USPC ..... 244/3.22, 171.1, 171.2, 171.3, 171.4, 244/158.9, 159.6; 102/377, 378; 89/1.14
See application file for complete search history.

(56) References Cited

U.S. PATENT DOCUMENTS

| | | | | |
|---|---|---|---|---|
| 1,378,291 | A | 5/1921 | Sperry | |
| 4,175,491 | A | 11/1979 | Thomanek | |
| 4,776,539 | A | 10/1988 | Byers et al. | |
| 5,123,612 | A | 6/1992 | Labroche et al. | |
| 5,927,653 | A | 7/1999 | Mueller et al. | |
| 6,565,036 | B1 | 5/2003 | Palathingal et al. | |
| 6,832,740 | B1 | 12/2004 | Ransom | |
| 7,082,878 | B2 * | 8/2006 | Facciano et al. | 102/377 |
| 7,600,421 | B1 | 10/2009 | Hollis et al. | |
| 7,763,834 | B2 * | 7/2010 | Teneze et al. | 244/3.22 |
| 2005/0000383 | A1 * | 1/2005 | Facciano et al. | 102/377 |
| 2005/0269454 | A1 | 12/2005 | Kobayashi et al. | |
| 2008/0245256 | A1 * | 10/2008 | Teneze et al. | 102/374 |
| 2009/0206204 | A1 | 8/2009 | Rosen | |
| 2009/0211258 | A1 | 8/2009 | Bulman | |

OTHER PUBLICATIONS

"Apollo 11 Lunar Landing Mlssion, Press Kit", NASA, Washington, D.C., Jul. 6, 1969.*

"Expert: European eXPErimental Reentry Testbed", [online], Retrieved from the Internet: <URL: http://www.esa.intMI/EXPERT/SEMYRKQORVF_0.html>, (Jul. 26, 2010), 16 pgs.

"International Application Serial No. PCT/US2011/056133, International Search Report mailed Mar. 12, 2012", 3 pgs.

(Continued)

*Primary Examiner* — Brian M O'Hara

(74) *Attorney, Agent, or Firm* — Schwegman, Lundberg & Woessner, P.A.

(57) ABSTRACT

Projectiles that include a propulsion system and a launch motor which are located on opposing sides of a payload and a method of directing a projectile toward a target are generally described herein. Placing the propulsion system and the launch motor on opposing sides of the payload may provide many potential advantages when designing the projectile. These design advantages may make it easier to create a projectile that includes more propellant and/or payload while still permitting the projectile to be stored within existing containers having a fixed size.

5 Claims, 10 Drawing Sheets

(56) References Cited

OTHER PUBLICATIONS

"International Application Serial No. PCT/US2011/056133, Written Opinion mailed Mar. 12, 2012", 5 ps.

Thirkettle, A. C., et al., "Mechanical Design and Engineering of The European Experimental Re-entry Testbed (Expert)", *11th European Conference on spacecraft structures, materials and mechanical testing,*[*online*]. [*retrieved Mar. 3, 2012*]. *Retrieved from the Internet:<: http://esamultimedia.esa.int/docs/EXPERT?Mech Design*_Engineering_Expert.pdf>, (Sep. 2009), 7 pgs.

Thirkettle, A. C., "EXPERT: The ESA experimental rentry test-bed: System Overview", *11th European Conference on spacecraft structures, materials and mechanical testing,* [*online*]. [*retrieved Mar. 3, 2012*]. *Retrieved from the Internet:<:http://esamultimedia.esa.int/docs/EXPERT/EXPERT*_Systems_Overview.pdf, (Jul. 2010), 16 pgs.

* cited by examiner

PROJECTILE THAT INCLUDES PROPULSION SYSTEM AND LAUNCH MOTOR ON OPPOSING SIDES OF PAYLOAD AND METHOD

TECHNICAL FIELD

Embodiments pertain to a projectile, and more particularly to a projectile that includes a launch motor and a propulsion system configured to deliver a payload.

BACKGROUND

Projectiles are typically designed in order to deliver a payload (e.g., kinetic weapon) to an intended release point at maximum velocity. Most projectiles have one or more stages of propulsion that are positioned behind the payload in order to provide thrust and attitude control.

Existing projectiles are typically stored within fixed-size containers. Since the containers have a fixed size, the projectiles are usually length-limited so that the projectile can fit within the fixed-size (i.e., length) container.

These size constraints limit the amount of propellant (or size of payload) that a given size projectile can carry. The size limitations within existing projectiles also make it difficult to include an appropriate amount of thermal insulation within the projectile. The thermal insulation is typically needed in order to protect the payload from aero-thermal heating as the projectile passes through the atmosphere.

Another drawback with existing projectiles is that it is often difficult to incorporate an aerospike on the forward end of the projectile. Aerospikes are difficult to incorporate into projectiles because they add unwanted length to the projectile. This unwanted additional length leads to a decrease in propellant (or payload packaging volume) in order to accommodate the aerospike within a container.

Thus, there are general needs for projectiles that allow for an effective increase in the amount of propellant and/or payload within a projectile without increasing the overall effective size (length) of the projectile. Increasing the amount of propellant and/or payload within the projectile without increasing the overall effective size of the projectile length allows an improved projectile to fit within existing fixed-size containers.

SUMMARY

Some embodiments relate to a projectile that includes a payload and a launch motor on an aft end of the projectile. The projectile further includes a propulsion system located on a fore end of the projectile. The propulsion system and the launch motor are located on opposing sides of the payload.

The launch motor directs thrust from the aft end of the projectile and the propulsion system is initially oriented to direct thrust in an opposite direction to the thrust generated by the launch motor. In some embodiments, the payload may include lateral thrusters that rotate the payload such that propulsion system becomes the aft end of the projectile once the launch motor has been ejected. In other embodiments, the propulsion system may include lateral thrusters that rotate the payload such that the propulsion system becomes the aft end of the projectile once the launch motor has been ejected. It should be noted that in those embodiments where the propulsion system includes lateral thrusters to rotate the projectile, the payload may also include lateral thrusters to rotate the payload after the propulsion system has been ejected.

The propulsion system may include a motor section that is attached to the payload and an expendable shroud that is attached to the motor section. In some embodiments, the expendable shroud may be a nose cone, although it should be noted that the expendable shroud may take different forms in other embodiments.

As an example, the expendable shroud may be formed of a plurality of components such that the components are adapted to telescope inside one another. The plurality of components that form the shroud may be collapsed when the projectile is stored within a container and expanded to form a nose cone when the projectile is removed from the container. The number, size and type of components that make up the nose cone will depend in part on the design of the propulsion system and the desired shape of the nose cone that is to be utilized on the projectile.

Embodiments are also contemplated where the shroud is formed as a blunt nose cone. Forming the shroud as a blunt cone allows projectile designers to more effectively utilize space within the projectile.

In some embodiments, the motor section may form part of the tapered nose cone. In other embodiments, the motor section may include a cylindrical casing to permit the motor section to store more propellant.

The propulsion system may include an aerospike that is positioned within the motor section and extends through the expendable shroud. The aerospike may include a head that rests on top of the expendable shroud, although it should be noted that the aerospike may take different forms in other embodiments. In some embodiments, the aerospike may be deployable from within the propulsion system to extend forward out of the projectile.

Other embodiments relate to a method of directing a projectile toward a target. The method includes directing the projectile along a flight path toward the target using a launch motor located on an aft end of the projectile and expelling the launch motor from an aft end of the projectile. The method further includes rotating the projectile such that a propulsion system located on a fore end of the projectile becomes the aft end of the projectile and directing the projectile along a flight path toward the target using the propulsion system.

In some embodiments, directing the projectile along a flight path toward the target using a launch motor located on an aft end of the projectile may include directing the projectile using a first booster motor, ejecting the first booster motor from the projectile and directing the projectile using a second booster motor. In addition, expelling the launch motor from an aft end of the projectile may include ejecting the second booster motor from the projectile.

Rotating the projectile such that a propulsion system located on a fore end of the projectile becomes the aft end of the projectile may include (i) rotating the projectile using lateral thrusters on the payload; and/or (ii) rotating the projectile using lateral thrusters on the propulsion system. In those embodiments where the projectile is rotated using lateral thrusters on the propulsion system, the method may further include ejecting the propulsion system and rotating the projectile using lateral thrusters on the payload in order to reverse the front and back ends of the payload.

In some embodiments, the method further includes expelling a shroud from the propulsion system in order to expose a motor section of the propulsion system. The type of shroud that is used will depend in part on the design of the rest of the propulsion system, especially the motor section of the propulsion system. As an example, the shroud may include a plurality of collapsed telescoped components such that method further includes expanding the collapsed plurality of components that are in a telescoping relationship in order form a nose cone.

The method may further include deploying an aerospike from within the propulsion system. As an example, the aerospike may be stored within a nozzle in the motor section of the propulsion system such that the aerospike is deployed forward from the projectile from a stored location inside the nozzle of the motor section.

Positioning the propulsion system of a projectile in front of the payload may allow the projectile to be designed with a more efficient use of space. As examples, the improved projectile may have more available volume to store propellant (or payload), and may provide space to store an aerospike within a nozzle of the propulsion system. In addition, the projectile may include an extendible nose cone that allows the projectile to be designed with a more efficient use of space for storage within a fixed-size container.

Other features and advantages will become apparent from the following description of the preferred example, which description should be taken in conjunction with the accompanying drawings.

DETAILED DESCRIPTION

Figure 1A:
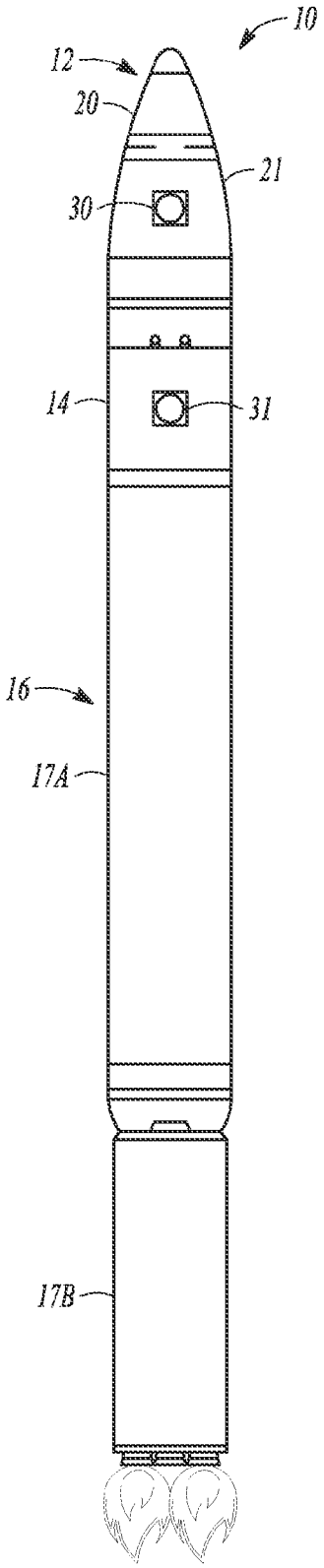
FIG. 1A is a side view of an example projectile in accordance with some embodiments.

The following description and the drawings sufficiently illustrate specific embodiments to enable those skilled in the art to practice them. Other embodiments may incorporate structural, logical, electrical, process, and other changes. Portions and features of some embodiments may be included in, or substituted for, those of other embodiments. Embodiments set forth in the claims encompass all available equivalents of those claims.

As used herein, projectile refers to missiles, interceptors, guided projectiles, unguided projectiles, rockets and submunitions.

As used herein, a fore end, or front end, of a projectile refers to the end of the projectile that is closest to the direction of travel at a particular point in time. In addition, as used herein, an aft end, or back end, of a projectile refers to the end of the projectile that is farthest from the direction of travel at a particular point in time.

The accompanying figures illustrate an example projectile 10 in accordance with some embodiments. In the illustrated example embodiment, the projectile 10 is a missile, although the scope of the embodiments is not limited in this respect.

As shown in FIGS. 1A-1I, the example projectile 10 includes a payload 14 and a launch motor 16 on an aft end of the projectile 10. The projectile 10 further includes a propulsion system 12 located on a fore end of the projectile 10. The propulsion system 12 and the launch motor 16 are located on opposing sides of the payload 14.

Placing the propulsion system 12 and the launch motor 16 on opposing sides of the payload 14 may provide many potential advantages when designing the projectile 10. These design advantages may make it easier to create a projectile 10 that includes more propellant and/or payload while still permitting the projectile 10 to be stored within existing containers having a fixed size.

The ability to maintain the overall size of the projectile 10 so that the projectile 10 can be stored within a fixed-size container is important because fixed-size containers are commonly utilized to store and/or transport the projectiles 10 in things like planes, ships, trucks, warehouse and the like. Changing the overall size of the projectile 10 may undesirably require a change to the containers, which may further require an unwanted change to the planes, ships, trucks, warehouses and so forth that store/transport the projectiles 10.

The payload 14 may be a kinetic warhead, satellite or any other item that needs to be delivered to a target or specific location. The type of payload 14 that is included in the projectile 10 will depend in part on the application where the projectile 10 is to be used.

In addition, the size of the payload 14 relative to the overall size of the projectile 10 will be determined in part by the type of mission where the projectile 10 is to be used. As an example, for missions that require the projectile 10 to travel a great distance, or achieve a greater velocity, the projectile 10 is likely to carry more propellant and have a smaller payload 14.

Figure 1B:
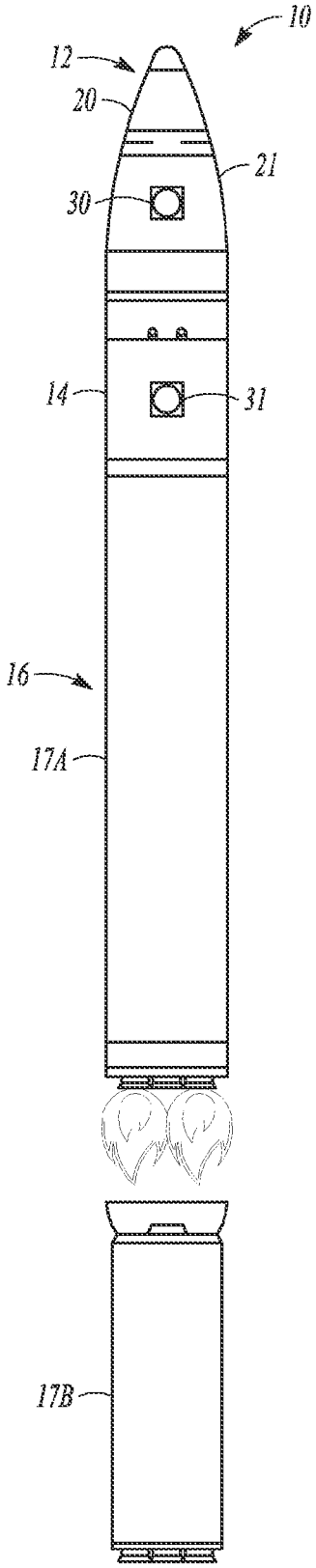
FIG. 1B is a side view of the projectile shown in FIG. 1A after a first booster stage has been ejected in accordance with some embodiments.
Figure 1C:
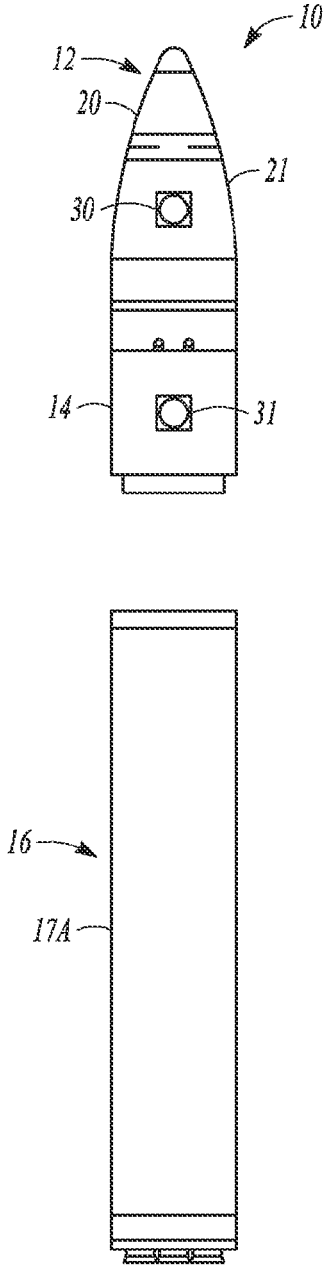
FIG. 1C is a side view of the projectile shown in FIG. 1B after the second booster stage has been ejected in accordance with some embodiments.

As shown in FIGS. 1A-1C, the launch motor 16 may include a first booster motor 17B and a second booster motor 17A. The type of launch motor 16, including the number of booster motors 17A, 17B, that are included in the projectile 10 will depend in part on the distance (or velocity) that the projectile 10 needs to travel as well as the application where the projectile 10 is to be used.

It should be noted that embodiments are contemplated where the projectile 10 includes one booster motor or more than two booster motors. In addition, when multiple booster motors are utilized in the projectile 10, each of the booster motors may be the same size (or different sizes) depending on the mission parameters.

The launch motor 16 directs thrust from the aft end of the projectile 10 and the propulsion system 12 is initially oriented to direct thrust in an opposite direction to the thrust generated by the launch motor 16. The propulsion system 12 is eventually used to direct the projectile 10 toward the target once the launch motor 16 has been ejected and the projectile 10 has been rotated (see, e.g., the rotating projectile 10 shown in FIGS. 1D-1F).

Figure 1D:
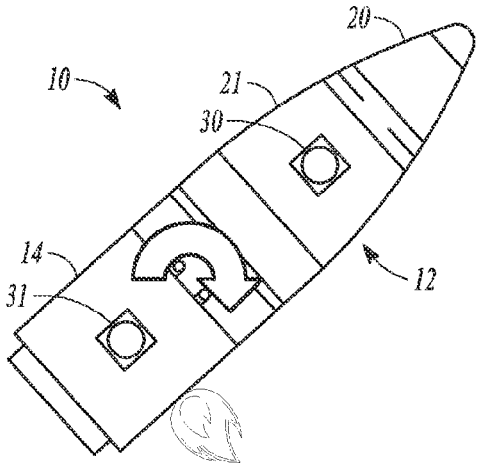
FIG. 1D is a side view of the projectile shown in FIG. 1C illustrating thrusters in the payload firing to rotate the projectile in accordance with some embodiments.
Figure 1E:
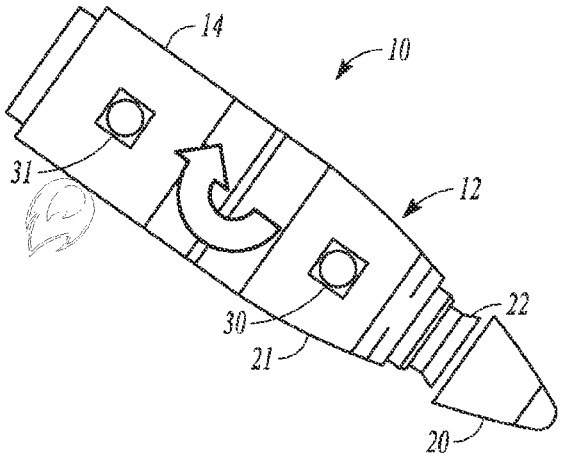
FIG. 1E is a side view of the projectile shown in FIG. 1D after the thrusters have further rotated the projectile and a shroud has been expelled from the front end of the projectile in accordance with some embodiments.

As shown in FIGS. 1D and 1E, the payload 14 may include lateral thrusters 31 that rotate the payload 14 such that the propulsion system 12 becomes the aft end of the projectile 10 once the launch motor 16 has been ejected. It should be noted any number, size, type and style of lateral thruster 31 may be included on the payload 14.

The number, size, type and style of lateral thruster 31 will depend in part on the overall configuration of the projectile 10 as well as the application where the projectile 10 is to be utilized. In addition, the arrangement of the lateral thrusters 31 on the payload 14 will be determined by desired maneuverability of the projectile 10 when using the lateral thrusters 31.

In other embodiments, the propulsion system 12 may include lateral thrusters 30 that rotate the payload 14 such that the propulsion system 12 becomes the aft end of the projectile 10 once the launch motor 16 has been ejected. It should be noted any number, size, type and style of lateral thruster 30 may be included on the propulsion system 12.

The number, size, type and style of lateral thruster 30 will depend in part on the overall configuration of the projectile 10 as well as the application where the projectile 10 is to be utilized. In addition, the arrangement of the lateral thrusters 30 on the propulsion system 12 will be determined by desired maneuverability of the projectile 10 when using the lateral thrusters 30.

In those embodiments where the propulsion system 12 includes lateral thrusters 30 to rotate the projectile 10, the payload 14 may also include lateral thrusters 32 to rotate the payload 14 after the propulsion system 12 has been ejected. As shown most clearly in FIGS. 1G-1H, the payload 14 may include additional lateral thrusters 32 that serve to rotate the payload 14 after the propulsion system 12 has been ejected (see, e.g., FIG. 1G). The number, size, type and style of lateral thruster 32 will depend in part on the overall configuration of the payload 14 and the arrangement of any other lateral thrusters that are included on the projectile 10.

In addition, the projectile 10 may be configured such that the payload 14 has a front end near the propulsion system 12 and a back end near the launch motor 16. The projectile 10 may further include a sensor 40 located at the front end of the payload 14 such that the sensor 40 acquires the target after the launch motor 16 and the propulsion system 12 have been ejected, and the lateral thrusters 32 in the payload 14 have rotated the payload 14 into an appropriate orientation (shown in FIG. 1I).

It should be noted that the type of sensor 40 that is used in the payload 14 will depend in part on the size and shape of the payload 14 as well as the application where the projectile 10 is to be used. Some example sensors that may be used in the projectile 10 include, but are not limited to, thermal, optical, ladar and radar (among others).

Figure 2A:
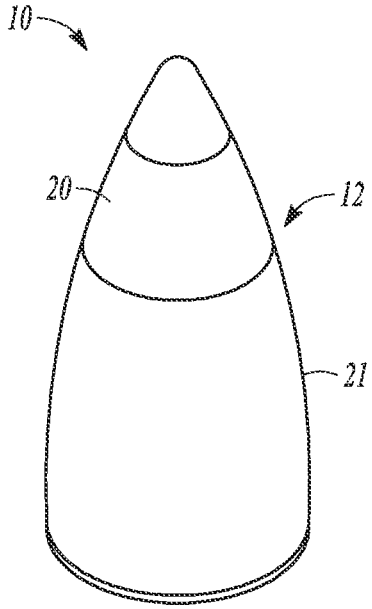
FIG. 2A is a perspective of an example propulsion system that may be used in the example projectile shown in FIGS. 1A-1F in accordance with some embodiments.
Figure 2B:
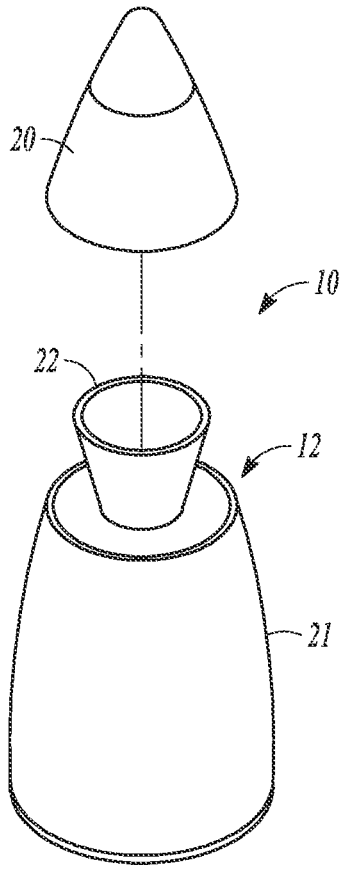
FIG. 2B is a perspective view of the example propulsion system shown in FIG. 2A where an expendable shroud has been expelled from a motor section of the propulsion system to expose a nozzle on the motor section in accordance with some embodiments.

As shown most clearly in FIGS. 2A-2B, the propulsion system 12 may include a motor section 21 that is attached to the payload 14 and an expendable shroud 20 that is attached to the motor section 21. The expendable shroud 20 may be attached to the motor section 21 in any manner that facilitates expelling the expendable shroud 20 from the propulsion system 12 at the appropriate time during the flight.

In some embodiments, the expendable shroud 20 may be a nose cone, although it should be noted that the expendable shroud 20 may take different forms in other embodiments. The overall size and shape of the expendable shroud 20 will depend on a variety of design considerations.

Figure 4B:
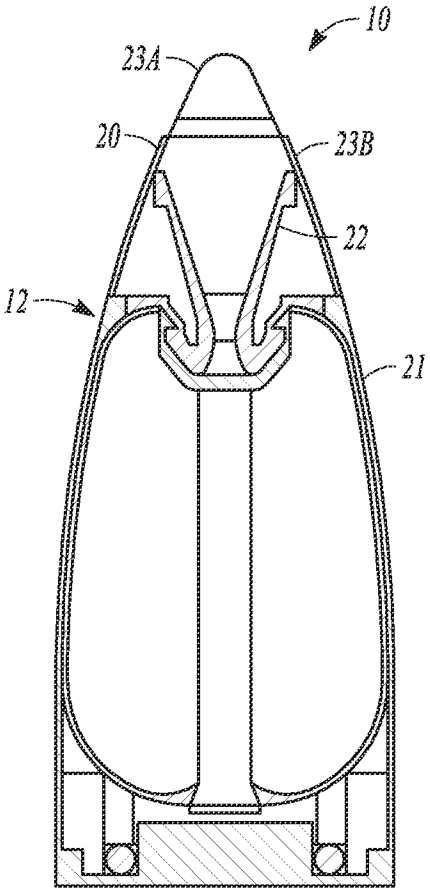
FIG. 4B is a schematic section view of the example projectile shown in FIG. 4A where the plurality of telescoped components are extended to form the nose cone in accordance with some embodiments.
Figure 4A:
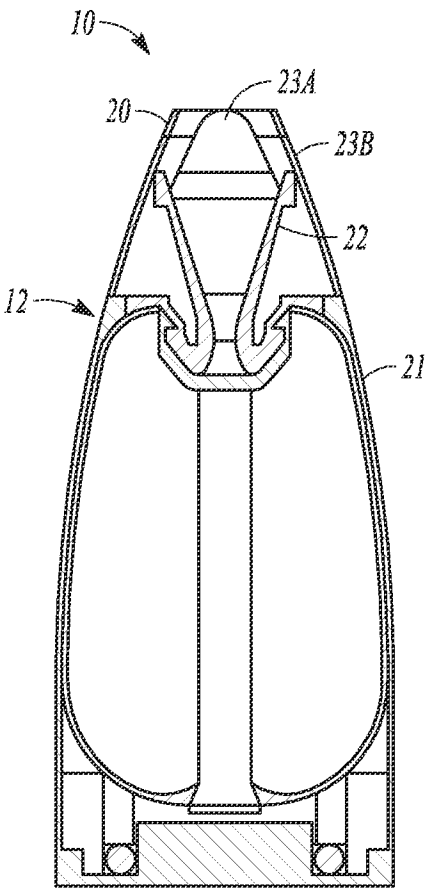
FIG. 4A is a schematic section view of another example propulsion system that may be used in the example projectile shown in FIGS. 1A-1F where the nose cone is formed of a plurality of telescoped components in accordance with some embodiments.
Figure 3:
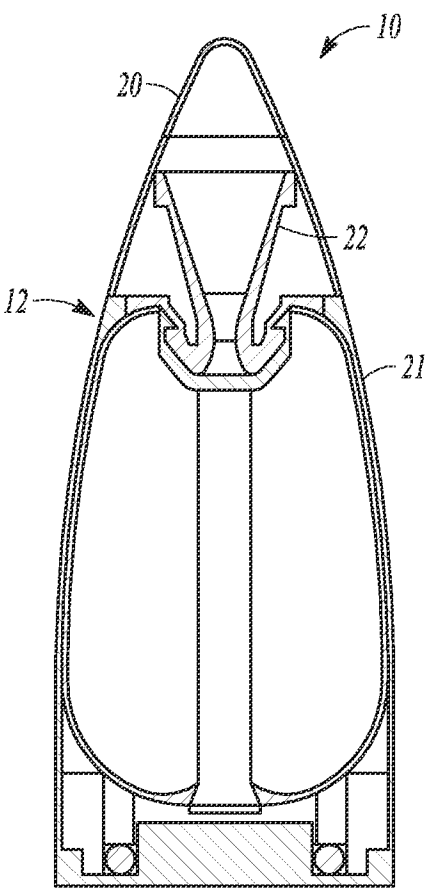
FIG. 3 is a schematic section view of an example propulsion system that may be used in the example projectile shown in FIGS. 1A-1F in accordance with some embodiments.

As shown in FIG. 3, the expendable shroud 20 may be formed of a single piece. Although in other embodiments, the expendable shroud 20 may be formed of a plurality of components 23A, 23B such that the components 23A, 23B are adapted to telescope inside one another (see, e.g. components 23A, 23B in FIGS. 4A-4B). FIG. 4A shows the components 23A, 23B collapsed into one another while FIG. 4B shows the components 23A, 23B expanded to form a nose cone.

It should be noted that embodiments are contemplated where the expendable shroud 20 is simply a cylinder such that there is no tapering within the shroud 20. Embodiments are also contemplated where the expendable shroud 20 and the motor section 21 form a cylinder.

Figure 1F:
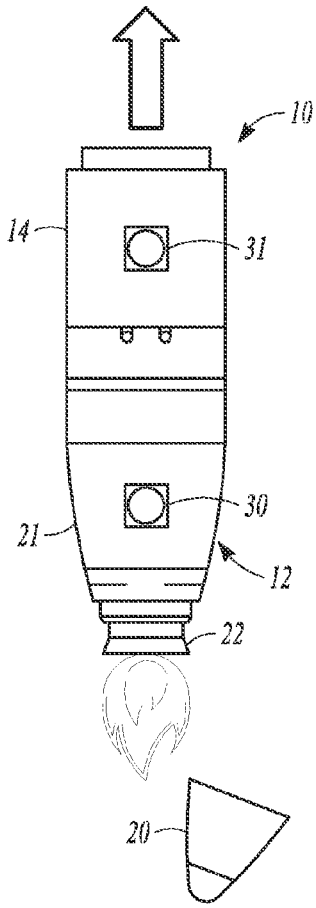
FIG. 1F is a side view of the projectile shown in FIG. 1E after the thrusters have rotated the projectile such that the payload is on the front end of the projectile in accordance with some embodiments.

FIGS. 1E and 1F show an example of the expendable shroud 20 being ejected from the rest of projectile 10 in accordance with some embodiments. Although FIGS. 1E and 1F show the expendable shroud 20 being ejected as single piece, it should be noted that the expendable shroud 20 may separate from the rest of the propulsion system 12 as multiple pieces.

As shown more clearly in FIGS. 2A-2B, once the shroud 20 is separated from the motor section 21, a nozzle 22 within the propulsion system 12 is exposed. The exposure of the nozzle 22 (see FIG. 2B) allows the propulsion system 12 to direct the projectile 10 toward the target once the projectile 10 has been rotated to reverse the front and back ends of the projectile 10 (see, e.g., FIG. 1F where the propulsion system 12 is directing the projectile 10).

In the illustrated example embodiments, the motor section 21 may form part of the tapered nose cone. The overall shape of the projectile 10 will depend in part on how (and where) the casing of the motor section 21 and the nose cone join together to form the outer surface of the projectile 10.

In other embodiments, the motor section 21 may include a cylindrical casing to permit the motor section 21 to store more propellant. The relative length of the cylindrical casing and size and shape of the nose cone will depend on a variety of design considerations.

Figure 5A:
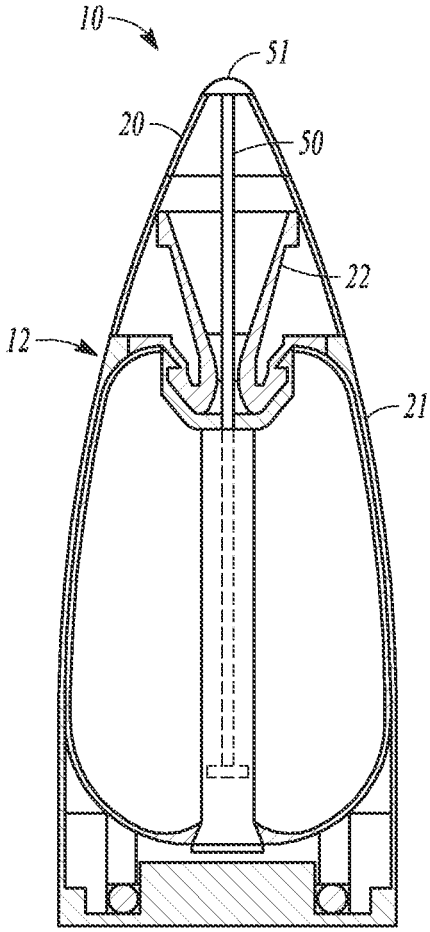
FIG. 5A is a schematic section view of an example projectile that includes an aerospike within the propulsion system in accordance with some embodiments.
Figure 5B:
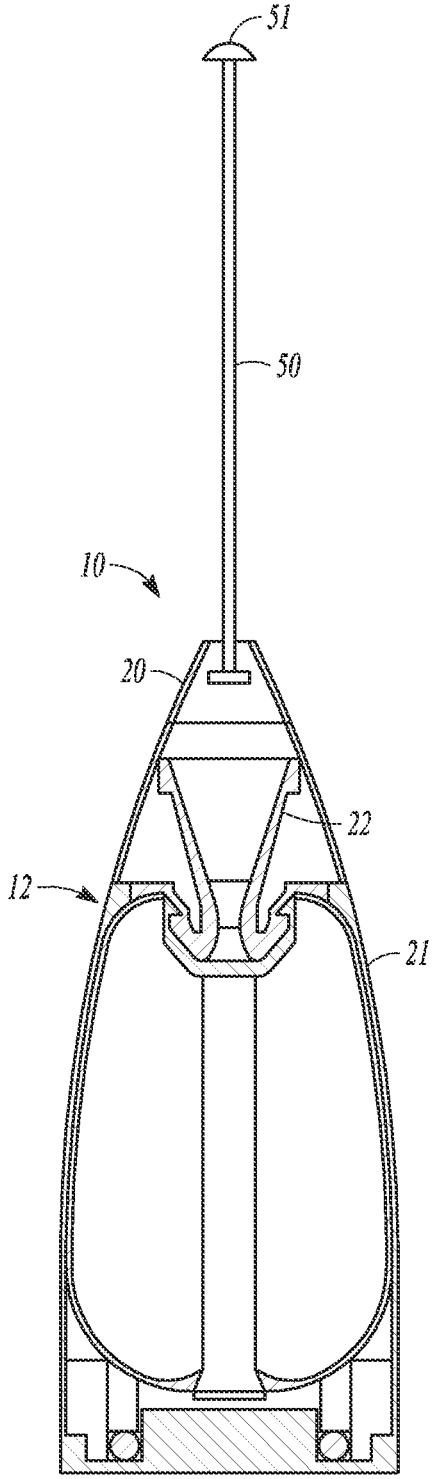
FIG. 5B is a schematic section view of the projectile shown in FIG. 5A where the aerospike has been deployed in accordance with some embodiments.

As shown in FIGS. 5A-5B, the propulsion system 12 may include an aerospike 50 that is positioned within the motor section 21 and extends through the expendable shroud 20. The aerospike 50 may be connected to the expendable shroud 20 in any manner that permits the expendable shroud 20 to be expelled from the rest of the projectile 10.

The aerospike 50 may include a head 51 that initially rests on top of the expendable shroud 20 (see, e.g., FIG. 5A where head 51 of aerospike 50 is on the shroud 20), although it should be noted that the aerospike 50 may take different forms in other embodiments. In some embodiments, the aerospike 50 may be deployable from within the propulsion system 12 to extend forward out of the projectile 10.

In the example embodiments that are illustrated in FIGS. 5A-5B, the deployable aerospike 50 extends through a nozzle 22 of the motor section 21. FIG. 5A shows the aerospike 50 in a stowed position within the motor section 21, while FIG. 5B shows the aerospike 50 extended into a deployed position.

The aerospike 50 may be deployed from the motor section 21 by any means that permits acceptable deployment from the propulsion system 12. As an example, the aerospike 50 may be deployed by an electric motor (not shown) within the propulsion system 12. It should be noted that the amount that the aerospike 50 is extended from the projectile 10 may be adjustable (during flight) to help maximize velocity by reducing drag on the projectile 10.

Another example way to deploy the aerospike 50 would be through the use of an air bag that is positioned below the aerospike 50. The air bag would inflate in order to deploy the aerospike 50 at the appropriate time during the flight.

Figure 6A:
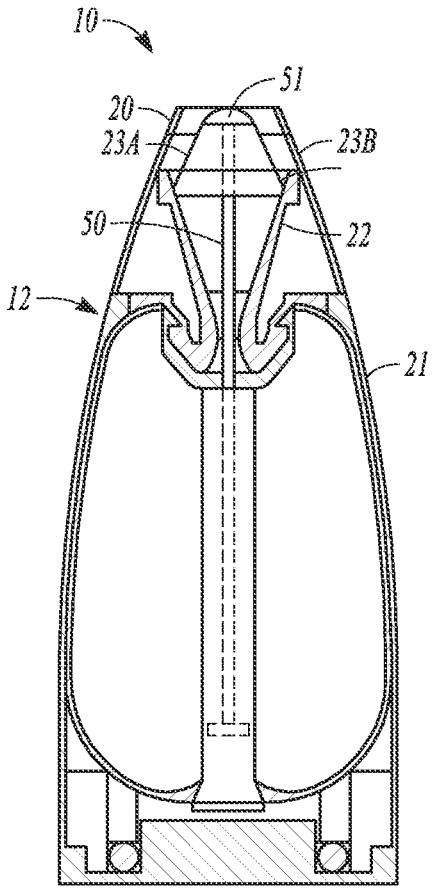
FIG. 6A is a schematic section view of an example projectile that includes an expandable nose cone and an aerospike within the propulsion system in accordance with some embodiments.
Figure 6B:
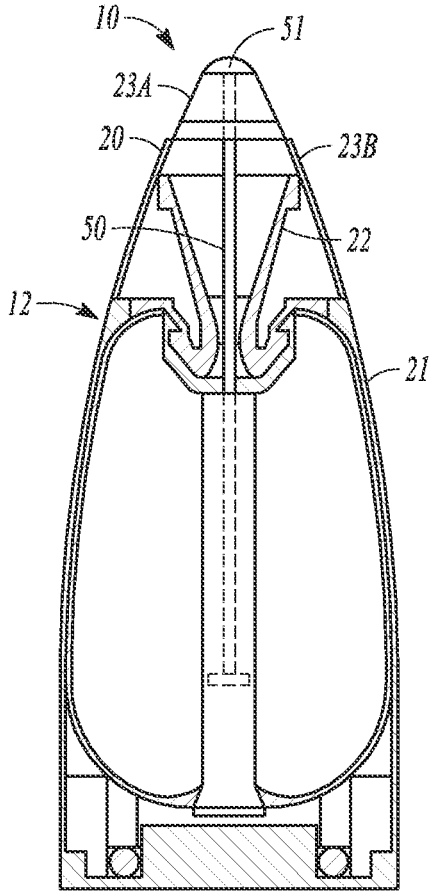
FIG. 6B is schematic section view of the projectile shown in FIG. 6A where the plurality of telescoped components are extended to form the nose cone in accordance with some embodiments.
Figure 6C:
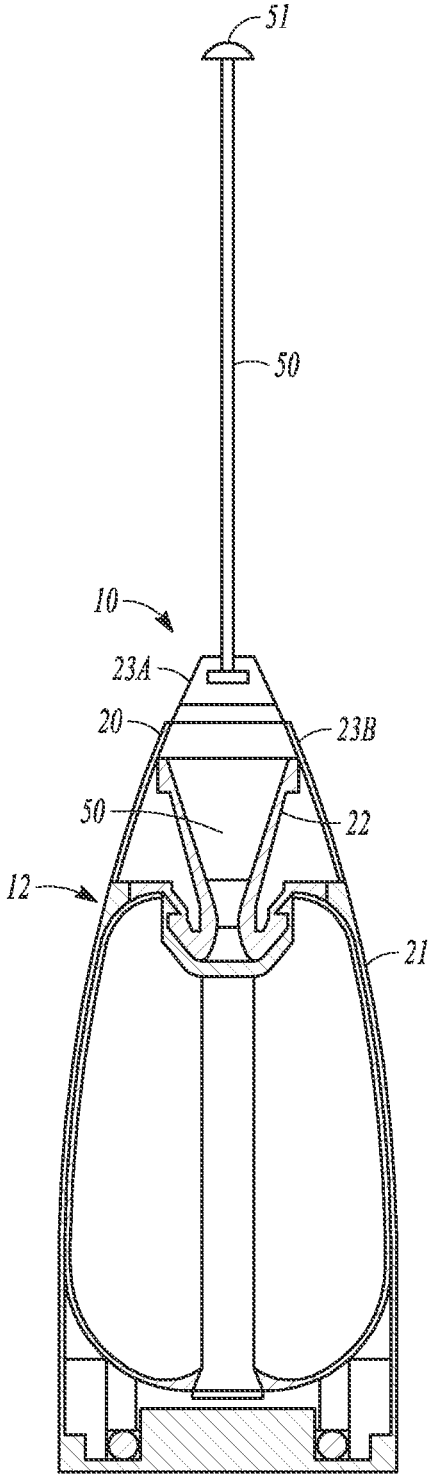
FIG. 6C is schematic section view of the projectile shown in FIG. 6B where the aerospike has been extended in accordance with some embodiments.

FIGS. 6A-6C illustrate an example embodiment where an aerospike 50 is combined with an expendable shroud 20 that is formed of a plurality of components 23A, 23B such that the components 23A, 23B are collapsed and telescoped inside one another to reduce the effective length of the projectile 10 during storage inside a container (see FIG. 6A).

The components 23A, 23B are expanded when the projectile 10 is removed from the container to form the nose cone (see FIG. 6B). In some embodiments, the device that is used to deploy the aerospike 50 may be the same device that is used to expand the components 23A, 23B which form the nose cone.

As shown in FIGS. 6A-6B, the head 51 of the aerospike 50 may remain against one of the components 23A until the aerospike 50 is deployed (see FIG. 6C). The number, size and type of components 23A, 23B that make up the nose cone will depend in part on the design of the aerospike 50 and the desired shape of the nose cone that is to be utilized on the projectile 10.

Figure 7A:
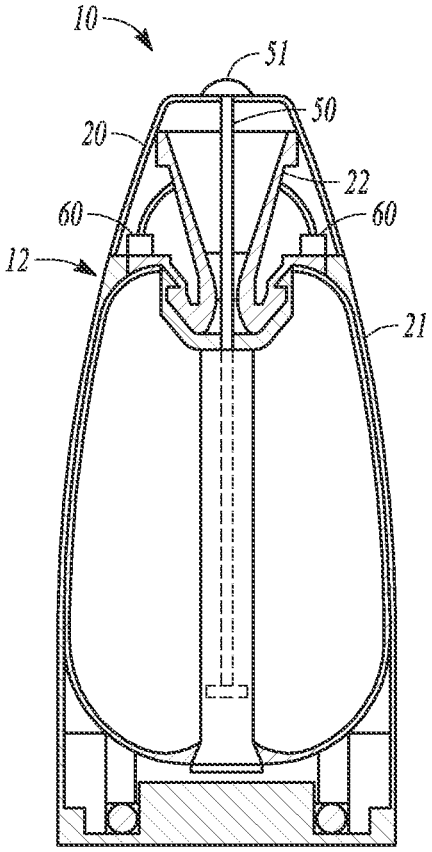
FIG. 7A is schematic section view of another projectile where the projectile includes a blunt nose cone and an aerospike within the propulsion system.
Figure 7B:
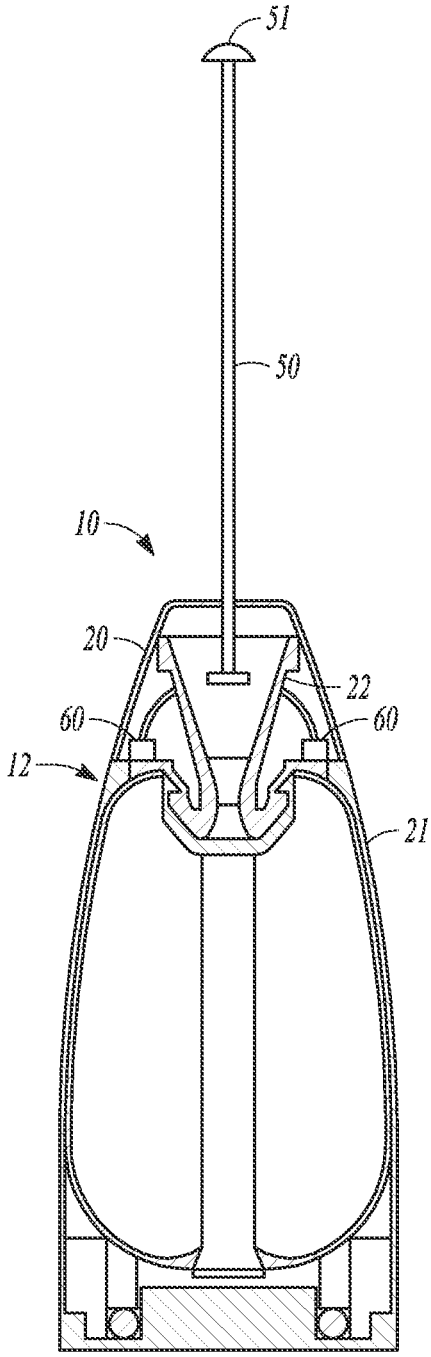
FIG. 7B is schematic section view of the projectile shown in FIG. 7A where the aerospike is deployed in accordance with some embodiments.

As shown in FIGS. 7A-7B, the shroud 20 may be formed as a blunt nose cone in other embodiments in order to more effectively utilize space within the projectile 10. Forming the shroud 20 as a blunt nose cone allows the space within the projectile to be used more effectively (i.e., to include more payload and/or propellant) because there is more capacity within a fixed overall length of the projectile 10. As discussed above, the length of the projectile 10 needs to be kept at or below a certain size in order for the projectile 10 to fit within containers that have a fixed size.

FIGS. 7A-7B also show that the propulsion system 12 may include an adjustment mechanism 60 that is used to maneuver the motor section 21. The type of adjustment mechanism 60 that is used to adjust the motor section 21 will depend on the design of the motor section 21 as well as desired maneuverability of the projectile 10 when the projectile 10 is being powered by the propulsion system 12.

One example adjustment mechanism 60 may be an electric ball screw actuator. Another example adjustment mechanism 60 may include a device that uses a hydraulic actuator.

One example concept of operation for the projectile 10 will now be described with reference to FIGS. 1A-1I.

FIG. 1A shows the projectile 10 being directed toward a target by launch motor 16. In the example embodiment illustrated in FIG. 1A, a first booster motor 17B is directing the projectile 10 toward the target.

As shown in FIG. 1B, the first booster motor 17B is expelled from the rest of the projectile 10. The projectile 10 is then being directed toward the target by a second booster motor 17A.

FIG. 1C shows the second booster motor 17A being expelled from the rest of the projectile 10. The projectile 10 is still traveling along a prescribed flight path even after the second booster motor 17A has been expelled.

As shown in FIG. 1D, lateral thrusters 31 on the payload 14 serve to start rotating the projectile 10. In other embodiments, lateral thrusters 30 on the propulsion system 12 may be used to start rotating the projectile 10.

FIG. 1E shows the lateral thrusters 31 on the payload 14 continuing to rotate the projectile 10. In addition, the shroud 20 on the projectile 10 has just been expelled from the rest of the projectile 10 in order to expose on a nozzle 22 in the motor section 21 of the propulsion system 12. It should be noted that in other operations, the shroud 20 may be expelled sooner or later than what is shown as an example in FIG. 1E. In some embodiments, the rotation of the projectile 10 may facilitate expelling the shroud 20 from the projectile 10.

As shown in FIG. 1F, the lateral thrusters 31 on the payload 14 rotate the projectile 10 until the front and back ends of the projectile 10 are reversed from what is illustrated in FIGS. 1A-1C. The lateral thrusters 31 on the payload 14 (and/or the lateral thrusters 30 on the propulsion system 12) may be used to stop the rotation of the projectile 10 so that the propulsion system 12 is behind the payload 14. Once the propulsion system 12 is behind the payload 14, the propulsion system 12 directs the projectile 10 toward the target.

Figure 1G:
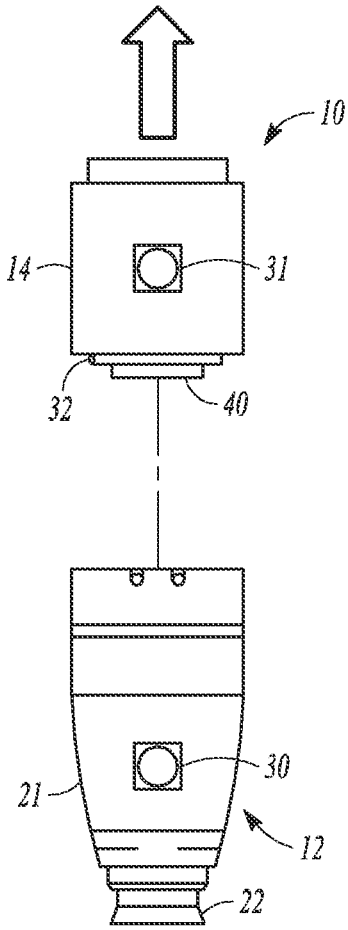
FIG. 1G is a side view of the projectile shown in FIG. 1F after the thrusters have rotated the projectile such that the payload is on the front end of the projectile and the propulsion system has been expelled in accordance with some embodiments.

FIG. 1G shows the remaining propulsion system 12 being expelled from the rest of the projectile 10. The remaining projectile 10 is still traveling along a prescribed flight path even after the motor section 21 of the propulsion system 12 has been expelled.

Figure 1H:
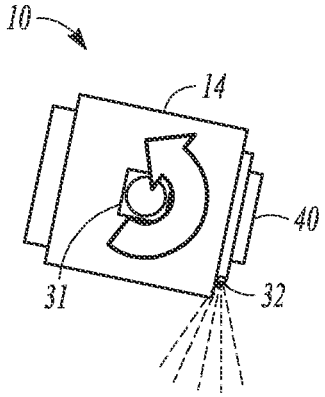
FIG. 1H is a side view of the projectile shown in FIG. 1G illustrating thrusters in the payload firing to again rotate the projectile in accordance with some embodiments.

As shown in FIG. 1H, lateral thrusters 32 on the payload 14 may serve to start rotating the projectile 10. The projectile 10 may need to be rotated in order to orient/align a sensor 40 on the projectile 10 so that the sensor 40 is facing the direction of travel.

Figure 1I:
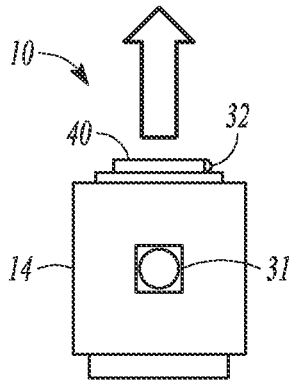
FIG. 1I is a side view of the projectile shown in FIG. 1H after the thrusters have further rotated the projectile to position a sensor on the projectile at the front end of the projectile in accordance with some embodiments.

FIG. 1I shows the projectile 10 after the lateral thrusters 32 on the projectile 10 have rotated the projectile 10 until the front and back ends of the projectile 10 are reversed from what is illustrated in FIG. 1G. The lateral thrusters 32 on the payload 14 may be used to stop the rotation of the projectile 10 so that the sensor 40 is facing the direction of travel. Once the sensor 40 is facing the direction of travel, the sensor 40 can direct the projectile 10 toward the target.

Figure 8:
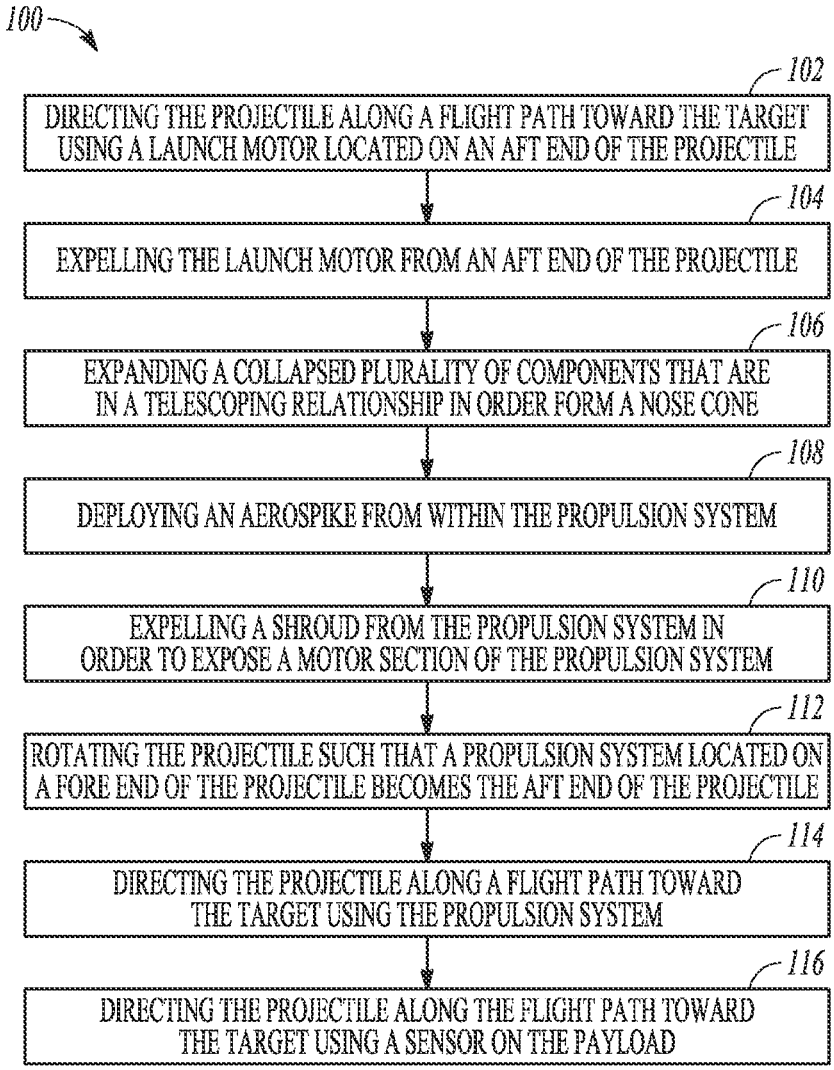
FIG. 8 is a flow diagram illustrating an example method of directing a projectile toward a target in accordance with some embodiments.

FIG. 8 shows an example of a method 100 of directing a projectile 10 toward a target. The description of the method 100 includes references to elements and features previously described herein. It should be noted that the operations of the method 100 may be performed by a system controller of the projectile 10 that includes one or more processors.

The references provided are intended to be exemplary and not limiting. Where reference is made to a particular element and a number is provided, the corresponding element listed is not limiting and instead includes other exemplary elements herein as well as their equivalents.

At 102, the method 100 includes directing the projectile 10 along a flight path toward the target using a launch motor 16 located on an aft end of the projectile 10 (see, e.g., launch motor 16 that includes booster motors 17A, 17B in FIG. 1A). In some embodiments, directing the projectile 10 along a flight path toward the target using a launch motor 16 located on an aft end of the projectile 10 may include directing the projectile 10 using a first booster motor 17B, ejecting the first booster motor 17B from the projectile 10 and directing the projectile 10 using a second booster motor 17A.

At 104, the method 100 further includes expelling the launch motor 16 from an aft end of the projectile 10. As shown in FIGS. 1B-1C, expelling the launch motor 16 from an aft end of the projectile 10 may include ejecting a first booster motor 17B from the projectile 10 (discussed above) and then ejecting a second booster motor 17A from the projectile 10. The manner and timing in which the launch motor 16 is expelled from the projectile 10 will depend in part on the overall mission for the projectile 10 as well as the number of booster motors that make up the launch motor 16.

At 112, the method 100 further includes rotating the projectile 10 such that a propulsion system 12 located on a fore end of the projectile 10 becomes the aft end of the projectile 10. In some embodiments, rotating the projectile 10 such that a propulsion system 12 located on a fore end of the projectile 10 becomes the aft end of the projectile 10 may include rotating the projectile 10 using lateral thrusters 31 on the payload 14. It should be noted that in the example embodiment shown in FIGS. 1D-1E, the lateral thrusters 31 on the payload 14 serve to rotate the projectile 10.

In other embodiments, rotating the projectile 10 may include using lateral thrusters 30 on the propulsion system 12. In those embodiments where the projectile 10 is rotated using lateral thrusters 30 on the propulsion system 12, the method 100 may further include ejecting the propulsion system 12 and rotating the projectile 10 using lateral thrusters 32 on the payload 14 in order to reverse the front and back ends of the payload 14. As an example, FIG. 1G shows the propulsion system 12 being ejected from the rest of the projectile 10 and FIG. 1H shows the payload 14 being rotated using the lateral thrusters 32 on the payload 14.

At 114, the method 100 further includes directing the projectile 10 along a flight path toward the target using the propulsion system 12. FIGS. 1D-1E illustrate an example embodiment of the projectile 10 being rotated into a position so that the propulsion system 12 can be used to direct the projectile 10 toward the target while FIG. 1F shows the projectile 10 being directed toward the target using the propulsion system 12.

At 116, the method 100 may further include directing the projectile 10 along the flight path toward the target using a sensor 40 on the payload 14 (see, e.g., FIG. 1I where sensor 40 is exposed and facing the direction of travel). The manner in which the sensor 40 directs the projectile 10 toward the target will depend in part on the overall mission for the projectile 10 as well as the type of sensor 40 that is included in the projectile 10.

At 110, the method 100 may further include expelling a shroud 20 from the propulsion system 12 in order to expose a motor section 21 of the propulsion system 12. The type of shroud 20 that is used will depend in part on the design of the rest of the propulsion system 12, especially the motor section 21 of the propulsion system 12.

In addition, the manner in which the shroud 20 is expelled will vary depending on the type of shroud 20 that is utilized. As discussed above, the shroud 20 may be expelled as a single piece or as multiple pieces.

In some embodiments, the shroud 20 may be expelled due to centrifugal forces that are generated on the shroud 20 as the projectile 10 rotates (see, e.g., FIGS. 1D-1E). In addition, a parachute (not shown) may be stored within the shroud 20. When the parachute is deployed, the parachute may use aerodynamic forces to (i) rotate the projectile; and (ii) pull the shroud 20 from the projectile 10.

In other embodiments, the shroud 20 may be expelled as a result of a force that is applied to the shroud 20 by some other portion of the projectile 10. As an example, a force may be applied to the shroud 20 by detonating an explosive charge near (or on) the shroud 20. As another example, a force may be applied to the shroud 20 by some type of mechanism that manually manipulates the shroud 20 (e.g., some form of triggering arm).

In some embodiments, the shroud 20 may include a plurality of collapsed telescoped components 23A, 23B such that at 106 method 100 further includes expanding the collapsed plurality of components 23A, 23B that are in a telescoping relationship in order form a nose cone. FIG. 3 illustrates an example embodiment where the shroud 20 is a single piece nose cone while FIGS. 4A-4B illustrate telescoped components 23A, 23B that are collapsed for storage of the projectile 10 (see FIG. 4A) and expanded into a nose cone once the projectile 10 is removed from storage (see FIG. 4B).

It should be noted that the number and type of telescoped components may vary depending on the desired configuration of the projectile 10, and in particular the shroud 20. The manner in which the components are expanded will depend in part on the shape of the components that are expanded to form the shroud 20.

In the example embodiment that is illustrated in FIGS. 4A-4B, one of the components 23A rests inside the other component 23B. The outer component 23B actually forms part of the casing of the propulsion system 12 while the inner component 23A moves relative to the outer component 23B to form the front end of the projectile 10 (i.e., the nose cone).

At 108, the method 100 may further include deploying an aerospike 50 from within the propulsion system 12. FIG. 5B illustrates an example projectile 10 where the aerospike 50 has been deployed.

In some embodiments, the aerospike 50 may be stored within a nozzle 22 in a motor section 21 of the propulsion system 12 (see FIG. 5A). The aerospike 50 is deployed forward from the projectile 10 from the stored location inside the nozzle 22 of the motor section 21 (see FIG. 5B).

The aerospike 50 may be deployed from the motor section 21 by any means that permits acceptable deployment of the aerospike 50 from the propulsion system 12. The manner in which the aerospike 50 is deployed will depend in part on the shape of the aerospike 50 as well as the overall size and shape of the projectile 10.

It should be noted that embodiments are contemplated where an aerospike 50 is utilized in combination with a shroud 20 that includes a plurality of telescoped components. In the example embodiment shown in FIGS. 6A-6C, the shroud 20 is formed of a plurality of collapsed telescoped components 23A, 23B (FIG. 6A) such that the components 23A, 23B are expanded (FIG. 6B) to form a nose cone before the aerospike 50 is deployed (FIG. 6C).

The projectiles and methods described herein may provide the ability to efficiently utilize space within the projectiles while still allowing the projectiles to be stored in fixed-size containers. In addition, placing the propulsion system in front of the payload and then rotating the projectile (i) allows items (e.g., an aerospike) to be stored within the projectiles before the propulsion system is used; (ii) allows a sensor to be more readily designed into a payload; and (iii) provides additional space to store more propellant and/or payload.

In the foregoing description, the subject matter has been described with reference to specific exemplary examples. However, it will be appreciated that various modifications and changes may be made without departing from the scope of the present subject matter as set forth herein. The description and figures are to be regarded in an illustrative manner, rather than a restrictive one and all such modifications are intended to be included within the scope of the present subject matter. Accordingly, the scope of the subject matter should be determined by the generic examples described herein and their legal equivalents rather than by merely the specific examples described above. For example, the steps recited in any method or process example may be executed in any order and are not limited to the explicit order presented in the specific examples. Additionally, the components and/or elements recited in any apparatus example may be assembled or otherwise operationally configured in a variety of permutations to produce substantially the same result as the present subject matter and are accordingly not limited to the specific configuration recited in the specific examples.

Benefits, other advantages and solutions to problems have been described above with regard to particular examples; however, any benefit, advantage, solution to problems or any element that may cause any particular benefit, advantage or solution to occur or to become more pronounced, are not to be construed as critical, required or essential features or components.

As used herein, the terms "comprises", "comprising", or any variation thereof, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials or components used in the practice of the present subject matter, in addition to those not specifically recited, may be varied or otherwise particularly adapted to specific environments, manufacturing specifications, design parameters or other operating requirements without departing from the general principles of the same.

The present subject matter has been described above with reference to examples. However, changes and modifications may be made to the examples without departing from the scope of the present subject matter. These and other changes or modifications are intended to be included within the scope of the present subject matter, as expressed in the following claims.

It is to be understood that the above description is intended to be illustrative and not restrictive. Many other examples will be apparent to those of skill in the art upon reading and understanding the above description. It should be noted that examples discussed in different portions of the description or referred to in different drawings can be combined to form additional examples of the present application. The scope of the subject matter should, therefore, be determined with reference to the appended claims, along with the full scope of equivalents to which such claims are entitled.

The Abstract is provided to comply with 37 C.F.R. Section 1.72(b) requiring an abstract that will allow the reader to ascertain the nature and gist of the technical disclosure. It is submitted with the understanding that it will not be used to limit or interpret the scope or meaning of the claims. The following claims are hereby incorporated into the detailed description, with each claim standing on its own as a separate embodiment.

What is claimed is:

1. A projectile comprising:

a payload;

a launch motor that directs thrust from an aft end of the projectile;

a propulsion system located on a fore end of the projectile, wherein the propulsion system and the launch motor are located on opposing sides of the payload, wherein the propulsion system includes a nozzle oriented to direct thrust in an opposite direction to the thrust generated by the launch motor and lateral thrusters; and wherein a flight path of the projectile comprises:

a first phase where the launch motor propels the projectile along the flight path; and a second phase where the launch motor is ejected from the projectile and the projectile is rotated such that the nozzle becomes an aft end of the projectile.

2. The projectile of claim 1 wherein the payload includes lateral thrusters that rotate the payload after the propulsion system has been ejected from the payload.

3. The projectile of claim 1 wherein the propulsion system includes a motor section attached to the payload and an expendable shroud attached to the motor section.

4. The projectile of claim 3 wherein the expendable shroud is a nose cone that is formed of a plurality of components such that the components are adapted to telescope inside one another.

5. The projectile of claim 3 wherein the motor section includes a cylindrical casing.

* * * * *